United States Patent [19]

Makabe et al.

[11] Patent Number: 4,671,149

[45] Date of Patent: Jun. 9, 1987

[54] METHOD OF PERFORATING A TEXTURE TO BE SEWN

[75] Inventors: Kazunori Makabe, Tokyo; Yoshiyuki Nakamura, Kawasaki, both of Japan

[73] Assignee: Taga Electric Co., Ltd., Tokyo, Japan

[21] Appl. No.: 811,476

[22] Filed: Dec. 20, 1985

[30] Foreign Application Priority Data

Dec. 27, 1984 [JP] Japan ..... 59-281581
Dec. 27, 1984 [JP] Japan ..... 59-281582

[51] Int. Cl.[4] ..... B26F 1/24; D06H 1/00

[52] U.S. Cl. ..... 83/30; 83/660; 83/925 CC; 310/325

[58] Field of Search ..... 83/30, 660, 866, 868, 83/701, 925 CC; 51/59 SS; 74/61, 87; 310/325

[56] References Cited

U.S. PATENT DOCUMENTS

| | | | |
|---|---|---|---|
| 2,445,934 | 7/1948 | Bodine, Jr. | 51/59 SS |
| 2,715,440 | 8/1955 | Havican et al. | 83/30 X |
| 3,468,203 | 9/1969 | Armelin et al. | 83/433 |
| 3,681,627 | 8/1972 | Murry et al. | 310/325 |
| 4,041,815 | 8/1977 | Davis et al. | 83/30 |
| 4,153,080 | 5/1979 | Murray, Jr. et al. | 83/30 X |
| 4,343,111 | 8/1982 | Inoue | 51/59 SS |
| 4,391,168 | 7/1983 | Gerber et al. | 83/925 CC X |

*Primary Examiner*—Frank T. Yost
*Attorney, Agent, or Firm*—Oblon, Fisher, Spivak, McClelland & Maier

[57] ABSTRACT

A method is disclosed for perforating materials with a metal needle whereby the method involves the utilization of an ultrasonic vibration signal being applied to the metal needle in order to vibrate the needle in an axial direction to thereby penetrate a plurality of layered materials due to the axial vibration of the metal needle.

2 Claims, 3 Drawing Figures

METHOD OF PERFORATING A TEXTURE TO BE SEWN

BACKGROUND OF THE INVENTION

Field of the Invention

This invention relates to a method of perforating a texture to be sewn for applying, at once to a number of textures to be sewn which are placed or layered one on another, positioning marks to be used upon sewing of the textures.

DISCUSSION OF BACKGROUND

Conventionally, in preparation for sewing a pocket, a hook, a button or an accessory on a texture upon sewing of a dress or the like, a rotary needle heated by a heater is rotated to penetrate a number of textures placed one on another thereby to form on the textures scorches which will be used later as marks for the intended sewing.

In order to raise the efficiency of such perforating operations, the number of textures placed one on another may be increased. This, however, will deteriorate penetration of the rotary needle through the textures. Particularly in the case of tight textures, penetration of the rotary needle will be worse. Accordingly, the power for rotating the rotary needle must be increased, and if the rotary needle is penetrated by force, yarn breakage may take place in the textures, or the rotary needle may become overheated to scorch the textures excessively so that, where the textures are made of synthetic fibers or the like, they may melt.

OBJECTS AND SUMMARY OF THE INVENTION

It is a first object of the present invention to provide a perforating method by which textures can be perforated without suffering from damages.

It is a second object of the invention to provide a method of perforating a texture to be sewn by which a number of layered textures of any type which may be tight can be perforated easily.

According to the present invention, ultrasonic vibrations are applied in an axial direction to a metal needle by an ultrasonic vibration source, whereby a plurality of layered textures are penetrated by the metal needle which is vibrating in the axial direction. Such ultrasonic vibrations may be applied intermittently to the metal needle.

As a result, axial acceleration will be caused in the metal needle by such ultrasonic vibrations. Particularly by intermittently vibrating the metal needle, peaks of amplitude and acceleration can be concentrated to the beginning of starting of production of vibrations, resulting in promotion of the penetrating action of the metal needle through the textures.

DETAILED DESCRIPTION OF THE PREFERRED EMBODIMENT

Figure 1:
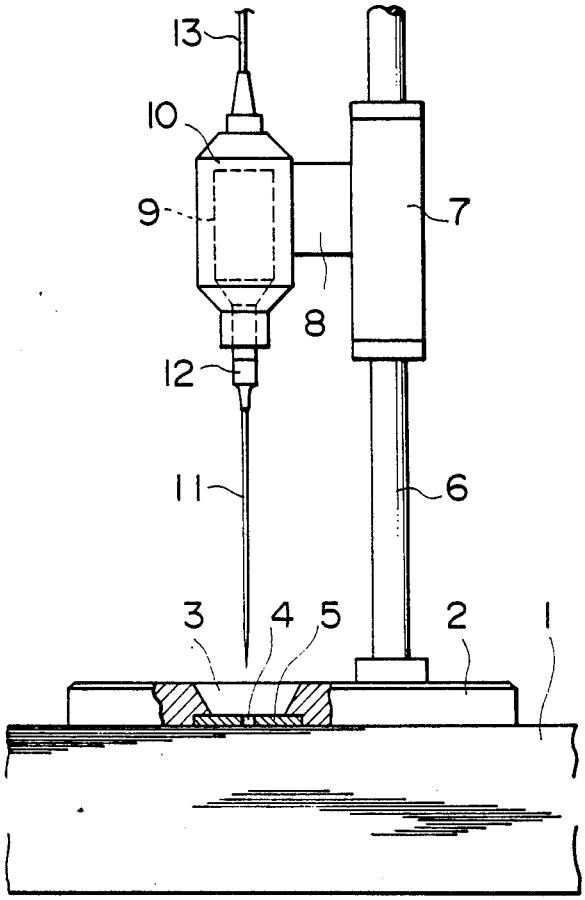
FIG. 1 is a side elevational view, partly broken, illustrating an embodiment of the present invention.

An embodiment of the present invention will be described with reference to the drawings. At first, a number of textures 1 are layered or placed one on another, and a base 2 is positioned to hold down the textures 1. The base 2 has an opening 3 formed therein, and a transparent plate 5 having a small hole 4 formed therein is disposed in the opening 3. A slider 7 is mounted for sliding movement on a shaft 6 mounted uprightly on the base 2. A support 8 is secured to the slider 7, and a casing 10 having an ultrasonic vibrator 9 contained therein is provided on the support 8. A holder 12 which holds a metal needle 11 thereon is connected to the ultrasonic vibrator 9. A cable 13 is held at an upper end portion of the casing 10 and couples the ultrasonic vibrator 9 to an ultrasonic vibration source (not shown).

Figure 2A:
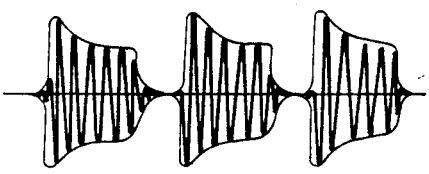
FIGS. 2(A) and 2(B) are a graph illustrating a controlling signal and a vibration wave of an ultrasonic vibration source.
Figure 2B:
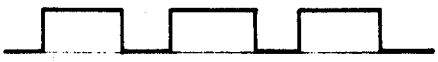

The ultrasonic vibrator 9 is driven to vibrate the metal needle 11 in an axial direction while the casing 10 is lowered together with the slider 7. In this instance, axial acceleration is caused in the metal needle 11 by the ultrasonic vibrations. Particularly by driving the ultrasonic vibration source with a controlling signal in the form of pulses as shown in (b) of FIG. 2 to intermittently vibrate the ultrasonic vibrator 9 together with the metal needle, peaks of amplitude and acceleration can be concentrated to the beginning of starting of production of ultrasonic vibrations as shown in (a) of FIG. 2. Accordingly, the penetrating action of the metal needle 11 through the textures 1 can be promoted. By vibrating the metal needle 11 also when it is to be pulled off the textures 1, it can be pulled off easily with reduced resistance.

Accordingly, when textures 1 of any type are to be perforated, and even where a number of such textures 1 are placed one on another, the textures 1 can be perforated easily without suffering from damages.

It is to be noted that while description of the embodiment is given of the case wherein intermittent ultrasonic vibrations are applied to the metal needle 11, similar effects can naturally be presented if continuous ultrasonic vibrations are otherwise applied to the metal needle 11 to perforate the textures 1.

We claim:

1. A method of perforating a texture to be sewn, comprising the steps of:

applying intermittent axial vibrations from an ultrasonic vibration source to a metal needle to vibrate said metal needle in an axial direction, whereby a number of layered textures can be penetrated by the axially vibrating metal needle.

2. A method of perforating a texture to be sewn according to claim 1, wherein said metal needle is positioned vertically.

* * * * *